US006418886B1

(12) United States Patent
Haimerl et al.

(10) Patent No.: US 6,418,886 B1
(45) Date of Patent: Jul. 16, 2002

(54) LIQUID-COOLED INTERNAL COMBUSTION ENGINE WITH CYLINDER BANKS, WHICH TILT TOWARD ONE ANOTHER, IN PARTICULAR A V ENGINE

(75) Inventors: Michael Haimerl; Walter Nederegger; Norbert Dembinski, all of Munich; Christian Absmeier, Margarethenried; Eckard Pueschel, Marzling, all of (DE)

(73) Assignee: Bavarische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/718,517

(22) Filed: Nov. 24, 2000

(30) Foreign Application Priority Data

Nov. 24, 1999 (JP) ..... 199 56 358

(51) Int. Cl.[7] ..... F02B 75/18

(52) U.S. Cl. ..... 123/41.28; 123/41.79; 123/54.4

(58) Field of Search ..... 123/41.72, 41.74, 123/41.82 R, 54.4, 54.6, 54.7, 54.8, 41.28, 41.79

(56) References Cited

U.S. PATENT DOCUMENTS 4,953,525 A * 9/1990 Sakurai et al. ..... 123/54.6

FOREIGN PATENT DOCUMENTS

EP 0 637 680 B1 11/1996

OTHER PUBLICATIONS

European Search Report

* cited by examiner

*Primary Examiner*—Noah P. Kamen
(74) *Attorney, Agent, or Firm*—Crowell & Moring LLP

(57) ABSTRACT

A liquid-cooled internal combustion engine has cylinder banks that tilt toward one another, to for a V engine. A coolant, which is fed to the exhaust gas-sided cooling jackets in the cylinder banks, is fed over cylinder heads with cross flow to cooling jackets. The coolant drains over break-throughs in the cylinder bank boundaries into an outflow line in the V-space. The outflow line and the inflow line are connected to a coolant pump. The coolant is fed from the inflow line over distribution channels at a housing end to the exhaust gas-sided cooling jackets.

17 Claims, 2 Drawing Sheets

LIQUID-COOLED INTERNAL COMBUSTION ENGINE WITH CYLINDER BANKS, WHICH TILT TOWARD ONE ANOTHER, IN PARTICULAR A V ENGINE

BACKGROUND AND SUMMARY OF THE INVENTION

This application claims the priority of German Patent Document 199 56 358.6, filed in Germany, Nov. 24, 1999, the disclosure of which is expressly incorporated by reference herein.

The German Patent Document DE 40 01 140 C1 shows and describes a coolant guide in a cylinder crankcase of a liquid-cooled V engine; the cross section of said crankcase being depicted in sections. The V-space of this V engine exhibits coolant channels for a coolant inflow and a coolant outflow with respect to the cooling jackets provided in the cylinder banks. These channels are molded into the lengthwise direction of the engine and can be closed with a separate cover. Thus, one cylinder bank is assigned the coolant inflow channel and the other cylinder bank is assigned the coolant outflow channel so as to be adjacent one another. Both coolant channels are separated essentially by a solid rib, whose cross section is triangular. Each of the coolant channels is connected directly to the adjacent cooling jacket in the cylinder bank, adjoining it, by means of breakthroughs in the cylinder bank boundaries. Each coolant channel is connected so as to guide coolant to the cooling jacket of the other separated cylinder bank by means of angular channels provided in the rib.

In this known coolant guide in a V engine, the inflowing coolant enters on the inside of the V-space into the cooling jackets of both cylinder banks and continues to flow on the exhaust gas side in the direction of the cylinder heads, from which it is fed to the coolant outflow channel over separate channels in the cylinder banks. Some examples of significant drawbacks are a poor distribution of heat in the cylinder crankcase, on the one hand, and a significant cost in separate channels, on the other hand due to the arrangement of the coolant channels in the cylinder banks which are arranged separately side by side as well as in the triangular ribs.

The invention is based on the problem of providing an improved coolant guide with a significantly simpler construction with improved thermal distribution for a class of internal combustion engine, designed in particular as a V engine.

This problem is solved in preferred embodiments of the present invention by providing a liquid-cooled internal combustion V engine with cylinder banks which tilt toward one another, comprising:

- a cylinder crankcase having a crankcase housing and a pair of cylinder banks configured in a V-shape to form a V space therebetween,
- a pair of cylinder heads assigned separately to each of the cylinder banks,
- external exhaust gas-sided cooling jackets and internal cooling jackets separated by cylinder pipes in each of the cylinder banks,
- a coolant inflow line extending between the cylinder banks in the V space and crankcase housing end-sided distribution channels operable to feed coolant to the respective external exhaust gas-sided cooling jackets,
- cross throughflow channels formed in the respective cylinder heads operable to guide coolant flow from the respective exhaust gas-sided cooling jackets to the internal coolant jackets which border the V space,

- an outflow line which is formed by crankcase housing end-sided cross walls and a separate cover, and
- throttle openings in cylinder bank boundaries in a bottom segment of the V space connecting the internal coolant jackets with the outflow line,
- wherein the inflow line is a separate line from the outflow line and is arranged imperviously in break-throughs of the cross walls,
- wherein the outflow line is connectable to a coolant pump by an outflow connection arranged in the V-space, and
- wherein the inflow line is connectable to a coolant pump by an inflow connection arranged in the V-space.

Preferred embodiments of the invention relate to a liquid-cooled internal combustion engine with cylinder banks that tilt toward one another, in particular a V engine comprising a cylinder crankcase and cylinder heads assigned separately to the cylinder banks. The cylinder banks exhibit external and internal cooling jackets, separated by cylinder pipes. A coolant is fed to the external, exhaust gas-sided cooling jackets by an inflow line, which extends between the cylinder banks in the V-space and by distribution channels, arranged on the side of the end of the crankcase housing. Said coolant passes on the exhaust gas side into the respective cylinder head and drains, according to a cross flow, into the V-space adjacent internal cooling jackets of the cylinder banks, from which the coolant passes by way of throttle openings in the cylinder bank boundaries in the bottom portion of the V-space into an outflow line. The outflow line is formed by crankcase housing end-sided cross walls and a separate cover. The longitudinally penetrating and separately designed inflow line is arranged imperviously in break-throughs of the cross walls. Assigned to a coolant pump connection of the inflow line is a connection of the outflow line, arranged geodetically above the inflow line.

The inventive spatial configuration of a first coolant channel and a second coolant channel in the V-space of a liquid-cooled V engine results in an advantageous manner in a cylinder crankcase whose construction is significantly simplified. In addition to an improved heat distribution, simpler ventilation of the coolant chambers is also achieved not only during the filling process but also in operation on account of the fact that the separate channels are also dispensed with.

In certain preferred embodiments of the invention the connection of the inflow line and the connection of the outflow line are essentially centered relative to the longitudinal center plane of the cylinder crankcase. In this manner a uniform pump arrangement and design is achieved for a coolant pump, arranged at an end face of the cylinder crankcase, for engines with varying V angles.

For automatic support of the ventilation of the coolant chambers, the cover closing the outflow line in the longitudinal direction of the engine, rises in the direction of the connection for the coolant pump.

The invention is described with reference to a V engine, which is shown in segments in the drawings.

Other objects, advantages and novel features of the present invention will become apparent from the following detailed description of the invention when considered in conjunction with the accompanying drawings.

DETAILED DESCRIPTION OF THE DRAWINGS

Figure 1:
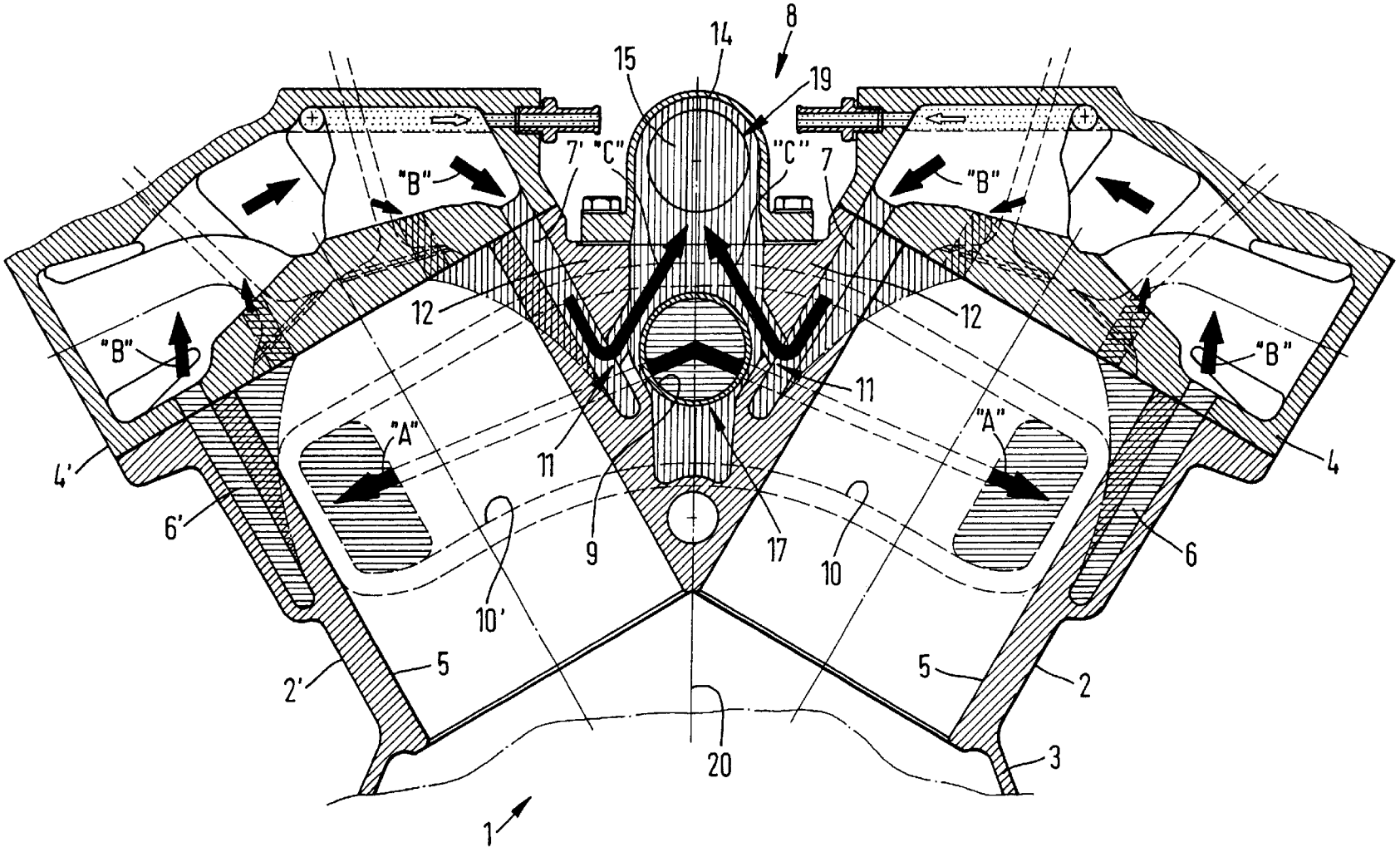
FIG. 1 is a sectional view of a V engine with coolant channels arranged according to a preferred embodiment of the present invention.
Figure 2:
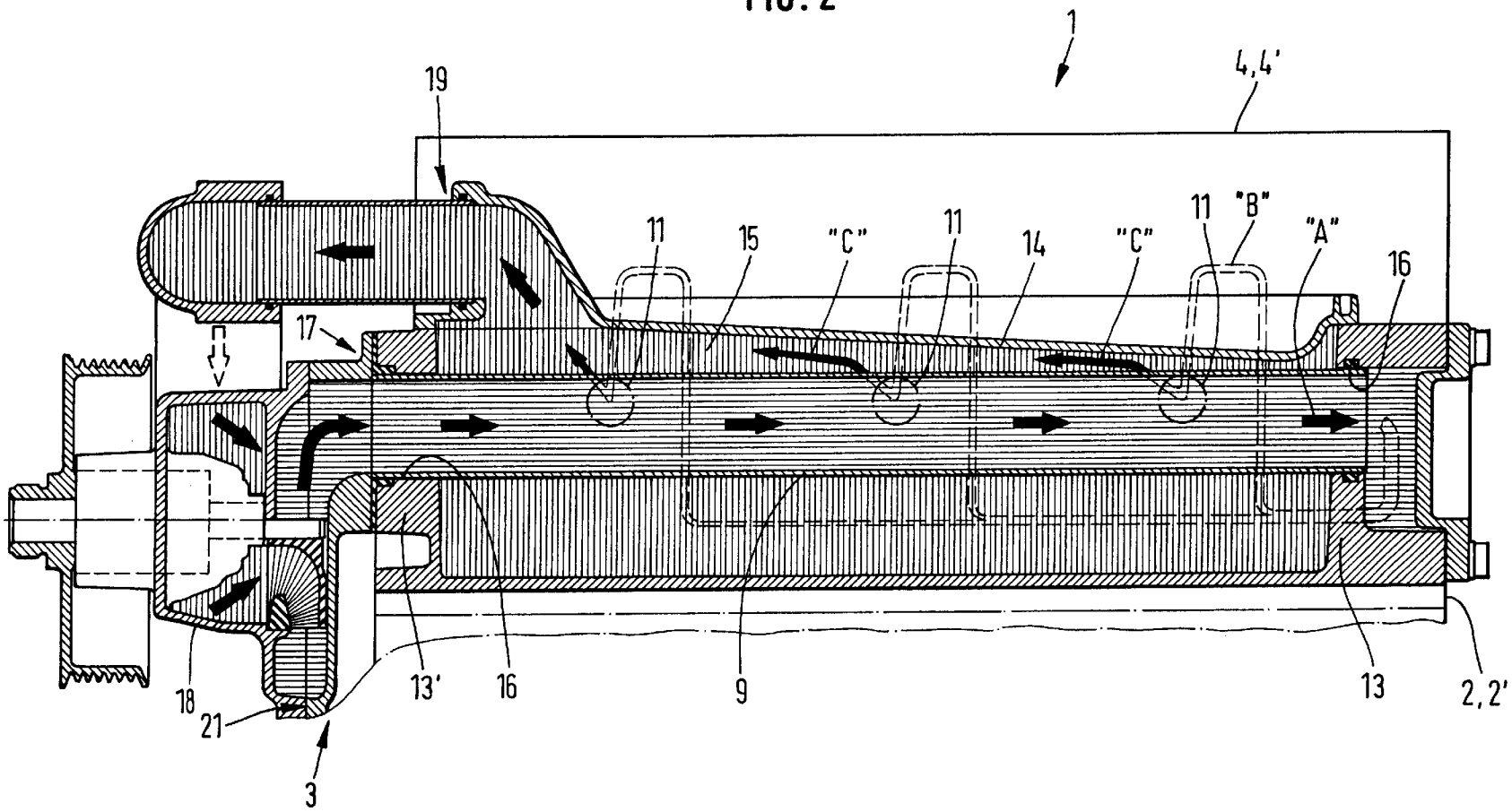
FIG. 2 is a longitudinal section view of segments of the V engine of FIG. 1 in the region of the coolant channels.

A liquid-cooled internal combustion engine 1, which is designed in particular as a V engine and exhibits cylinder banks 2, 2', which tilt toward one another, comprises a cylinder crankcase 3 and cylinder heads 4, 4', which are assigned separately to the cylinder banks 2, 2'. The cylinder banks 2, 2' exhibit external and internal cooling jackets 6, 6' and 7, 7', which are separated by cylinder pipes 5. Coolant, which passes on the exhaust gas-side into the respective cylinder head 4, 4' is fed according to the arrows "A" to the external exhaust gas-sided cooling jackets 6, 6' by an inflow line 9 running between the cylinder banks 2, 2' in the V space 8 and by crankcase housing end-sided distribution channels 10, 10'.

The coolant drains according to a cross throughflow of the cylinder heads 4, 4' indicated according to arrows "B" into the internal coolant jackets 7, 7', which border the V space 8 and which belong to the cylinder banks 2, 2'. The coolant passes from the internal coolant jackets 7,7', via throttle openings 11 in the cylinder bank boundaries 12 in the bottom segment of the V space 8 into an outflow line 15, formed by crankcase housing end-sided cross walls 13, 13' and a separate cover 14.

The separate inflow line 9 is arranged imperviously in the outflow line 15 and extends longitudinally in the V space 8 supported at and penetrating the break-throughs 16 of the crankcase housing cross walls 13, 13'.

Furthermore, it is clear from the figures that a connection 17 of the inflow line 9 for a coolant pump 18 is assigned a connection 19. Connection 19 is arranged geodetically above the pump and belongs to the outflow line 15 for the coolant pump 18. As evident from FIG. 1, the connection 17 of the inflow line 9 and the connection 19 of the outflow line 15 are in essence centered relative to the longitudinal center plane 20 of the cylinder crankcase 3. Thus, in the case of a coolant pump 18 which is arranged at an end face of the cylinder crankcase 3, it is possible to achieve a uniform pump arrangement and pump design for varying V angles.

To support automatic ventilation of the coolant chambers when filling and operating the V engine 1, the outflow line 15 is closed by a cover 14, which rises in the direction of the coolant pump connection 19. Other ventilation spots are provided at geodetic peaks in the cylinder heads 4 and 4'.

Furthermore, there are the throttle openings 11, provided in the cylinder bank boundaries 12, in order to drain the coolant from the internal cooling jackets 7, 7', facing the V space 8, in the center plane of the respective cylinder pipe 5. In this manner with this arrangement ventilation is also supported especially in the case of bowed cylinder bank boundaries 12. Furthermore, to control the heat distribution in the cylinder crankcase 3, these throttle openings 11 can exhibit varying cross sections along the length of said cylinder crankcase.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Liquid-cooled internal combustion V engine with cylinder banks which tilt toward one another, comprising:

a cylinder crankcase having a crankcase housing and a pair of cylinder banks configured in a V-shape to form a V space therebetween, a pair of cylinder heads assigned separately to each of the cylinder banks, external exhaust gas-sided cooling jackets and internal cooling jackets separated by cylinder pipes in each of the cylinder banks, a coolant inflow line extending between the cylinder banks in the V space and crankcase housing end-sided distribution channels operable to feed coolant to the respective external exhaust gas-sided cooling jackets, cross throughflow channels formed in the respective cylinder heads operable to guide coolant flow from the respective exhaust gas-sided cooling jackets to the internal coolant jackets which border the V space, an outflow line which is formed by crankcase housing end-sided cross walls and a separate cover, and throttle openings in cylinder bank boundaries in a bottom segment of the V space connecting the internal coolant jackets with the outflow line, wherein the inflow line is a separate line from the outflow line and is arranged imperviously in break-throughs of the cross walls, wherein the outflow line is connectable to a coolant pump by an outflow connection arranged in the V-space, and wherein the inflow line is connectable to a coolant pump by an inflow connection arranged in the V-space.

2. Internal combustion engine as claims in claim 1, wherein the outflow connection is disposed geodetically above the inflow connection.

3. Internal combustion engine as claimed in claim 2, wherein the separate cover forming part of the outflow line rises in a direction toward the outflow connection.

4. Internal combustion engine as claimed in claim 3, wherein a coolant pump is arranged at an end face of the cylinder crankcase.

5. Internal combustion engine as claimed in claim 1, wherein the separate cover forming part of the outflow line rises in a direction toward the outflow connection.

6. Internal combustion engine as claimed in claim 5, wherein a coolant pump is arranged at an end face of the cylinder crankcase.

7. Internal combustion engine as claimed in claim 1, wherein the inflow connection and the outflow connection are centered relative to a longitudinal center plane of the cylinder crankcase.

8. Internal combustion engine as claimed in claim 3, wherein the separate cover forming part of the outflow line rises in a direction toward the outflow connection.

9. Internal combustion engine as claimed in claim 8, wherein a coolant pump is arranged at an end face of the cylinder crankcase.

10. Internal combustion engine as claimed in claim 3, wherein a coolant pump is arranged at an end face of the cylinder crankcase.

11. A coolant system for an internal combustion engine with cylinder banks arranged in a V-shape to form a V-space between the cylinder banks comprising:

a coolant pump disposed at a first end of the cylinder banks, a coolant inflow line leading from the pump in the V-space to an opposite second end of the cylinder banks, and a coolant outflow line leading from said second end of the cylinder banks in the V-space back to the first end of the cylinder banks, wherein coolant from the inflow line is guided first to exhaust gas-sided cooling jackets of the cylinder banks disposed at sides of cylinders facing away from the V-space, then through cylinder heads to cooling jackets at sides of the cylinders facing the V-space, and then to the outflow line.

12. A coolant system according to claim 11, wherein the coolant inflow line is disposed below the coolant outflow line in the V-space.

13. A coolant system according to claim 12, wherein the coolant inflow and outflow lines are centered relative to a longitudinal center plane of said engine which bisects said V-space.

14. A coolant system according to claim 11, wherein the coolant outflow line is formed by a section of a cylinder crankcase and a cover detachably connected to this section.

15. A coolant according to claim 14, wherein the cover rises vertically in a direction from the second end to the first end of the cylinder banks.

16. A coolant system according to claim 15, wherein the coolant inflow line is disposed below the coolant outflow line in the V-space.

17. A coolant system according to claim 16, wherein the coolant inflow and outflow lines are centered relative to a longitudinal center plane of said engine which bisects said V-space.

* * * * *